US008951017B2

(12) United States Patent
Cordier et al.

(10) Patent No.: US 8,951,017 B2
(45) Date of Patent: Feb. 10, 2015

(54) TURBOMACHINE BLADE, A ROTOR, A LOW PRESSURE TURBINE, AND A TURBOMACHINE FITTED WITH SUCH A BLADE

(75) Inventors: Damien Cordier, Les Ecrennes (FR); Jean-Luc Soupizon, Vaux Le Penil (FR); Julien Mateo, Carigan de Bordeaux (FR); Georges Habarou, Le Bouscat (FR)

(73) Assignees: Snecma, Paris (FR); Herakles, Le Haillan (FR)

( * ) Notice: Subject to any disclaimer, the term of this patent is extended or adjusted under 35 U.S.C. 154(b) by 695 days.

(21) Appl. No.: 13/190,809

(22) Filed: Jul. 26, 2011

(65) Prior Publication Data

US 2012/0027605 A1 Feb. 2, 2012

(30) Foreign Application Priority Data

Jul. 27, 2010 (FR) ..... 10 56173

(51) Int. Cl.

*F01D 5/30* (2006.01)
*F01D 5/28* (2006.01)
*F01D 5/32* (2006.01)

(52) U.S. Cl.

CPC ..... *F01D 5/284* (2013.01); *F01D 5/282* (2013.01); *F01D 5/326* (2013.01)
USPC ..... 416/220 R

(58) Field of Classification Search

CPC ..... F01D 5/30; F01D 5/3007; F01D 5/32; F01D 5/323; F01D 5/326; F01D 5/16; F04D 29/322; F04D 29/668
USPC ..... 416/500, 220 R, 193 A, 219 R, 248, 224, 416/140
See application file for complete search history.

(56) References Cited

U.S. PATENT DOCUMENTS

| | | | | | |
|---|---|---|---|---|---|
| 941,375 | A | * | 11/1909 | Loud et al. | 416/220 R |
| 2,751,189 | A | * | 6/1956 | Ledwith | 416/217 |
| 2,819,869 | A | | 1/1958 | Meyer, Jr. | |
| 3,039,738 | A | * | 6/1962 | McDowall et al. | 416/131 |
| 3,178,101 | A | * | 4/1965 | Morley et al. | 416/224 |
| 3,216,699 | A | * | 11/1965 | Schoenborn | 416/190 |

(Continued)

FOREIGN PATENT DOCUMENTS

| | | |
|---|---|---|
| EP | 0 736 668 A1 | 10/1996 |
| EP | 2 009 247 A2 | 12/2008 |

(Continued)

OTHER PUBLICATIONS

French Preliminary Search Report issued Mar. 14, 2011, in French Application No. 1056173, filed Jul. 27, 2010 (with English Translation of Category of Cited Documents).

*Primary Examiner* — Nathaniel Wiehe
*Assistant Examiner* — Eldon Brockman
(74) *Attorney, Agent, or Firm* — Oblon, Spivak, McClelland, Maier & Neustadt, L.L.P.

(57) ABSTRACT

The invention relates to a turbomachine blade made of composite material and presenting a root with a bulb-shaped end suitable for engaging in a slot of a rotor disk. In characteristic manner, the end of the root of the blade is provided, beside one of its front faces, with a projecting portion having two symmetrical fins about the axial midplane of the root, each fin having a bearing face suitable for limiting tilting of the blade relative to the rotor disk about the axial direction.

12 Claims, 3 Drawing Sheets

(56) References Cited

U.S. PATENT DOCUMENTS

| | | | | | |
|---|---|---|---|---|---|
| 3,248,081 | A * | 4/1966 | Bobo et al. | 416/191 |
| 3,378,230 | A * | 4/1968 | Toomey | 416/221 |
| 3,458,119 | A * | 7/1969 | Shaw | 416/216 |
| 3,479,009 | A * | 11/1969 | Bean | 416/216 |
| 3,501,249 | A * | 3/1970 | Scalzo et al. | 416/95 |
| 3,666,376 | A * | 5/1972 | Damlis | 416/219 R |
| 3,720,480 | A | 3/1973 | Plowman et al. | |
| 3,748,060 | A * | 7/1973 | Hugoson et al. | 416/92 |
| 3,752,600 | A * | 8/1973 | Walsh et al. | 416/219 R |
| 3,891,351 | A * | 6/1975 | Norbut | 416/219 R |
| 4,343,593 | A * | 8/1982 | Harris | 416/193 A |
| 4,389,161 | A * | 6/1983 | Brumen | 416/220 R |
| 4,453,890 | A | 6/1984 | Brantley | |
| 4,466,776 | A * | 8/1984 | Camboulives | 416/221 |
| 4,477,226 | A * | 10/1984 | Carreno | 416/144 |
| 4,480,957 | A | 11/1984 | Patel et al. | |
| 4,655,687 | A * | 4/1987 | Atkinson | 416/193 A |
| 4,995,788 | A * | 2/1991 | Turnberg | 416/230 |
| 5,049,035 | A * | 9/1991 | Marlin | 416/193 A |
| 5,259,728 | A * | 11/1993 | Szpunar et al. | 416/2 |
| 5,350,279 | A * | 9/1994 | Prentice et al. | 416/220 R |
| 5,435,694 | A * | 7/1995 | Kray et al. | 416/219 R |
| 5,478,207 | A * | 12/1995 | Stec | 416/219 R |
| 5,713,721 | A * | 2/1998 | Glynn et al. | 416/220 R |
| 5,749,706 | A * | 5/1998 | Maar | 416/220 R |
| 6,102,664 | A | 8/2000 | Nguyen | |
| 6,109,877 | A * | 8/2000 | Gekht et al. | 416/221 |
| 6,190,131 | B1 * | 2/2001 | Deallenbach | 416/144 |
| 6,354,803 | B1 * | 3/2002 | Grover et al. | 416/190 |
| 6,398,499 | B1 * | 6/2002 | Simonetti et al. | 416/193 A |
| 6,431,835 | B1 * | 8/2002 | Kolodziej et al. | 416/219 R |
| 6,769,877 | B2 * | 8/2004 | Martin et al. | 416/193 A |
| 6,860,722 | B2 * | 3/2005 | Forrester et al. | 416/219 R |
| 7,121,805 | B2 * | 10/2006 | Chang et al. | 416/210 R |
| 7,153,098 | B2 * | 12/2006 | Zabawa | 416/2 |
| 7,156,621 | B2 * | 1/2007 | Stone | 416/219 R |
| 7,399,159 | B2 * | 7/2008 | Matheny et al. | 416/62 |
| 7,415,763 | B2 * | 8/2008 | Miosga et al. | 29/889.21 |
| 7,549,846 | B2 * | 6/2009 | Dube et al. | 416/239 |
| 7,581,931 | B2 * | 9/2009 | Shaefer et al. | 416/198 A |
| 7,938,626 | B2 * | 5/2011 | Forgue et al. | 416/221 |
| 7,976,281 | B2 * | 7/2011 | Keith et al. | 416/193 A |
| 8,192,167 | B2 * | 6/2012 | Helmis et al. | 416/220 R |
| 8,226,366 | B2 * | 7/2012 | Brucher et al. | 416/221 |
| 8,496,439 | B2 * | 7/2013 | Rajagopalan | 416/220 R |
| 8,568,082 | B2 * | 10/2013 | Beckford et al. | 415/9 |
| 2004/0062653 | A1 * | 4/2004 | Di Paola et al. | 416/221 |
| 2004/0062655 | A1 * | 4/2004 | Potter et al. | 416/241 R |
| 2004/0131471 | A1 * | 7/2004 | Richards et al. | 416/220 R |
| 2004/0151590 | A1 * | 8/2004 | Forrester et al. | 416/219 R |
| 2005/0118028 | A1 * | 6/2005 | Matheny et al. | 416/219 R |
| 2005/0232777 | A1 * | 10/2005 | Gautreau et al. | 416/219 R |
| 2005/0254953 | A1 * | 11/2005 | Stone | 416/219 R |
| 2006/0056974 | A1 * | 3/2006 | Beattie | 416/193 A |
| 2006/0073021 | A1 * | 4/2006 | Garner | 416/220 R |
| 2006/0088419 | A1 * | 4/2006 | Hermiston et al. | 416/220 R |
| 2007/0031259 | A1 * | 2/2007 | Dube et al. | 416/193 A |
| 2007/0148002 | A1 * | 6/2007 | Douville et al. | 416/220 R |
| 2008/0095632 | A1 * | 4/2008 | Phipps | 416/219 R |
| 2008/0286106 | A1 * | 11/2008 | Keith et al. | 416/193 A |
| 2009/0004013 | A1 * | 1/2009 | Ramlogan et al. | 416/190 |
| 2009/0081046 | A1 * | 3/2009 | Mace et al. | 416/219 R |
| 2009/0220345 | A1 * | 9/2009 | Krutzfeldt et al. | 416/220 R |
| 2009/0252611 | A1 * | 10/2009 | Tipton et al. | 416/220 R |
| 2010/0068062 | A1 * | 3/2010 | DiMascio et al. | 416/219 R |
| 2010/0189562 | A1 * | 7/2010 | Blanchard et al. | 416/219 R |
| 2010/0189564 | A1 * | 7/2010 | Stone | 416/221 |
| 2010/0226777 | A1 * | 9/2010 | Forgue et al. | 416/221 |
| 2010/0329872 | A1 * | 12/2010 | Kasperski | 416/219 R |
| 2011/0255982 | A1 * | 10/2011 | Jan | 416/220 R |
| 2012/0177498 | A1 * | 7/2012 | Yarava et al. | 416/220 R |
| 2012/0251328 | A1 * | 10/2012 | Connor et al. | 416/219 R |
| 2012/0315144 | A1 * | 12/2012 | Agaram et al. | 416/220 R |
| 2013/0108449 | A1 * | 5/2013 | Joshi et al. | 416/219 R |

FOREIGN PATENT DOCUMENTS

| | | | |
|---|---|---|---|
| EP | 2 108 785 | A2 | 10/2009 |
| GB | 2 100 808 | A | 1/1983 |
| GB | 2 138 078 | A | 10/1984 |

* cited by examiner

FIG.3
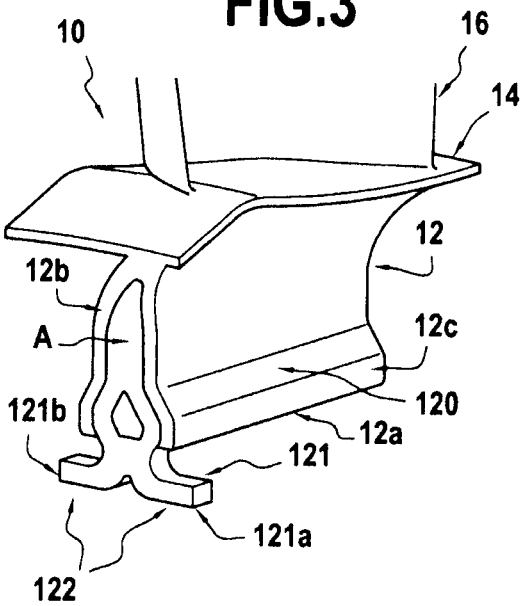
FIG.4
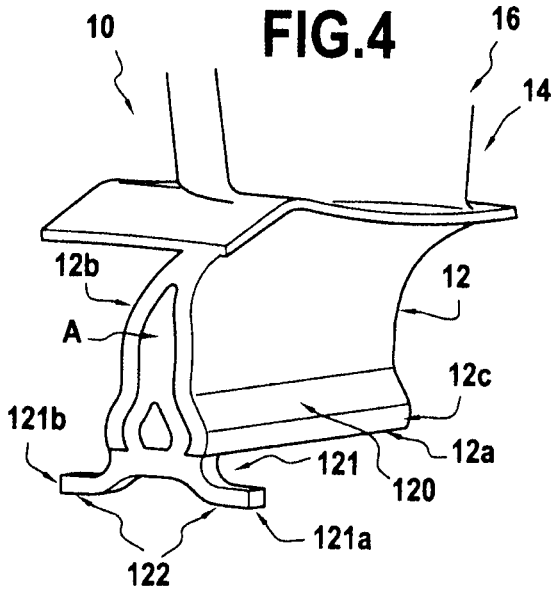
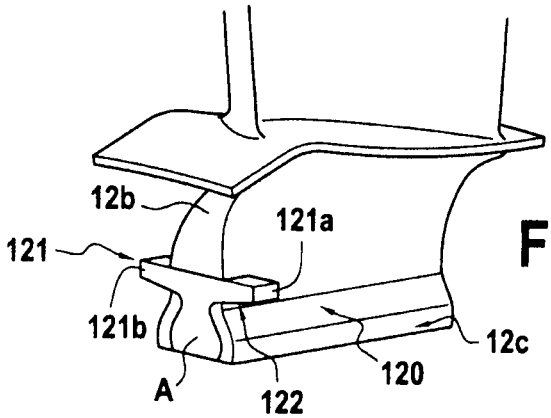
FIG.5
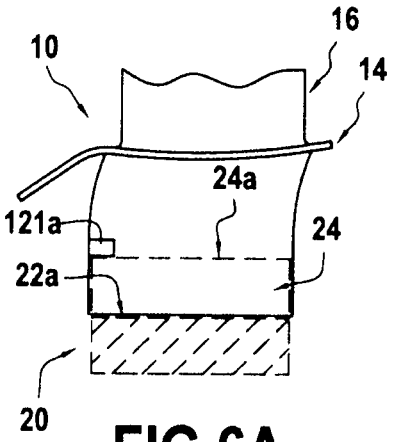
FIG.6A
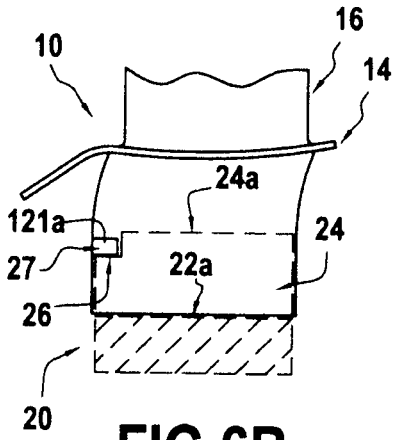
FIG.6B

TURBOMACHINE BLADE, A ROTOR, A LOW PRESSURE TURBINE, AND A TURBOMACHINE FITTED WITH SUCH A BLADE

FIELD OF THE INVENTION

The invention relates to the general field of moving wheels or rotors for a gas turbine, and particularly but not exclusively to low pressure turbine rotors of an aviation turbomachine.

BACKGROUND OF THE INVENTION

The low pressure turbine of an aviation turbomachine is made up of a plurality of stages, each stage including a nozzle (i.e. a grid of stationary guide vanes) and a rotor wheel placed behind the nozzle.

Typically, a low pressure turbine rotor is made up of a rotor disk provided at its periphery with slots in which the roots of the blades are engaged. An annular plate fastened to the rotor disk serves to hold the blades axially on the disk.

At present, it is common practice to replace the metal blades of such a rotor with blades that are made of composite material, while the rotor disk continues to be made of metal.

The use of a composite material for making blades is justified by the very good behavior of composite materials at the high temperatures to which blades are subjected, and also to their lower density (where composite materials present a density that is divided by about 3.5 relative to the density of the metal).

Nevertheless, having recourse to composite materials for making the blades of a gas turbine rotor wheel raises the problem of holding them in the slots of the disks. In operation, differences of expansion between the disk (made of metal) and the blades (made of composite material, in particular ceramic matrix composite (CMC) material) can give rise to contact being lost at the bearing surfaces of the blade roots. Under such circumstances, this loss of contact can lead to a blade tilting in the slot about a direction that is parallel to the central axis of symmetry of the turbomachine.

It is known to have recourse to a spacer placed between the bottom of the slot and the inner face of the blade root.

Document FR 2 918 129 provides for having recourse to a spacer of elastically deformable material with a longitudinal segment presenting a transverse profile of arcuate shape.

Nevertheless, such a spacer does not always manage to oppose sufficiently the above-mentioned tilting movements between the blade root and the corresponding slot.

In addition, having recourse to a spacer presents several drawbacks, including the fact of being expensive and of requiring each spacer to be made to measure, which is not compatible with mass production. It is necessary to adapt and fit the dimensions of each spacer to its future location as a function of the shape presented by the pair constituted by the slot and the blade root that is associated therewith. In addition, there is a risk of assembly errors, with spacers being interchanged, and there is also a problem of spacer traceability being relatively burdensome to manage.

OBJECT AND SUMMARY OF THE INVENTION

An object of the present invention is to provide a solution that constitutes an alternative to spacers and that enables the drawbacks of the prior art to be overcome.

To this end, the present invention provides a turbomachine blade made of composite material, in which the long dimension defines a radial direction, and that presents a root extending in an axial direction, with a bulb-shaped end suitable for engaging in a slot of a rotor disk, wherein the end of the root of the blade includes an enlarged portion and is provided, beside one of its front faces, with a projecting portion extending in a transverse direction and including two fins that are symmetrical relative to the axial midplane of the root and each of which has a bearing face suitable for limiting tilting of the blade relative to the rotor disk about the axial direction.

In this way, it can be understood that by associating the projecting portion of each blade that forms a projection having two fins extending in the transverse direction of the blade at the location of one of the front faces at the end of the blade root, with the disk, or more precisely with a retaining face of the disk, it is possible to establish contact between these elements in such a manner as to prevent, or at least greatly limit, the above-mentioned tilting.

This solution also presents the additional advantage of further making it possible to achieve standardized mass production and assembly suitable for being industrialized.

The invention also relates to a turbomachine rotor comprising blades as described above and a metal disk that is provided at its periphery with slots extending in an axial direction for receiving the roots of the blades, the disk being provided with a retaining face facing towards the periphery of the disk and against which the bearing faces of the fins of the projecting portion of each blade comes to bear.

In an advantageous arrangement, the retaining face is formed by an annular shoulder facing towards the periphery (outer face) of the disk and placed on one of the front faces of the disk.

Thus, the ends of the fins of the projecting portion bear against the retaining face formed by said annular shoulder facing towards the peripheral (or outer face) of the disk. It should be observed that in order to ensure contact between the projecting portion of each blade and said annular shoulder, the shoulder may be continuous or discontinuous. If it is discontinuous, the annular shoulder is made up of segments, each extending over an angular sector that is sufficient to enable both of the fins of the associated projecting portion to bear thereagainst.

The invention also provides a low pressure turbine including at least one blade of the kind described above.

The invention also provides a turbomachine including at least one blade of the kind described above.

BRIEF DESCRIPTION OF THE DRAWINGS

Other advantages and characteristics of the invention appear on reading the following description made by way of example and with reference to the accompanying drawings, in which:

FIG. 3 is a fragmentary perspective view of a blade showing the root of the blade, in a second variant of the first embodiment of the rotor of the invention;

FIG. 4 is a view similar to FIG. 3 for a third variant of the first embodiment of the rotor of the invention;

FIG. 5 is a view similar to FIG. 3 for a first variant of a second embodiment of the rotor of the invention;

FIGS. 6A and 6B are partially transparent section views in a radial plane of the assembly formed by the blade and the disk, showing one of the two fins of the projecting portion bearing against the disk, in two possible mounting configurations.

MORE DETAILED DESCRIPTION

In the present application, and unless specified to the contrary, "upstream" and "downstream" are defined relative to the normal flow direction of gas (from upstream to downstream) through the turbomachine. Furthermore, the axis of the turbomachine is the radial axis of symmetry of the turbomachine. The axial direction corresponds to the direction of the turbomachine axis, and a radial direction is a direction perpendicular to said axis and intersecting it. Similarly, an axial plane is a plane containing the axis of the turbomachine, and a radial plane is a plane perpendicular to said axis and intersecting it. The transverse (or circumferential) direction is a direction perpendicular to the axis of the turbomachine that does not intersect said axis. Unless specified to the contrary, the adjectives "axial", "radial", and "transverse" (and likewise the adverbs "axially", "radially", and "transversely") are used with reference to the above-specified axial, radial, and transverse directions. Finally, unless specified to the contrary, the adjectives "inner" and "outer" are used relative to a radial direction such that an inner portion or face (i.e. a radially inner portion or face) of an element is closer to the axis of the turbomachine than is an outer portion or face of the same element (i.e. a radially outer portion or face).

Figure 1:
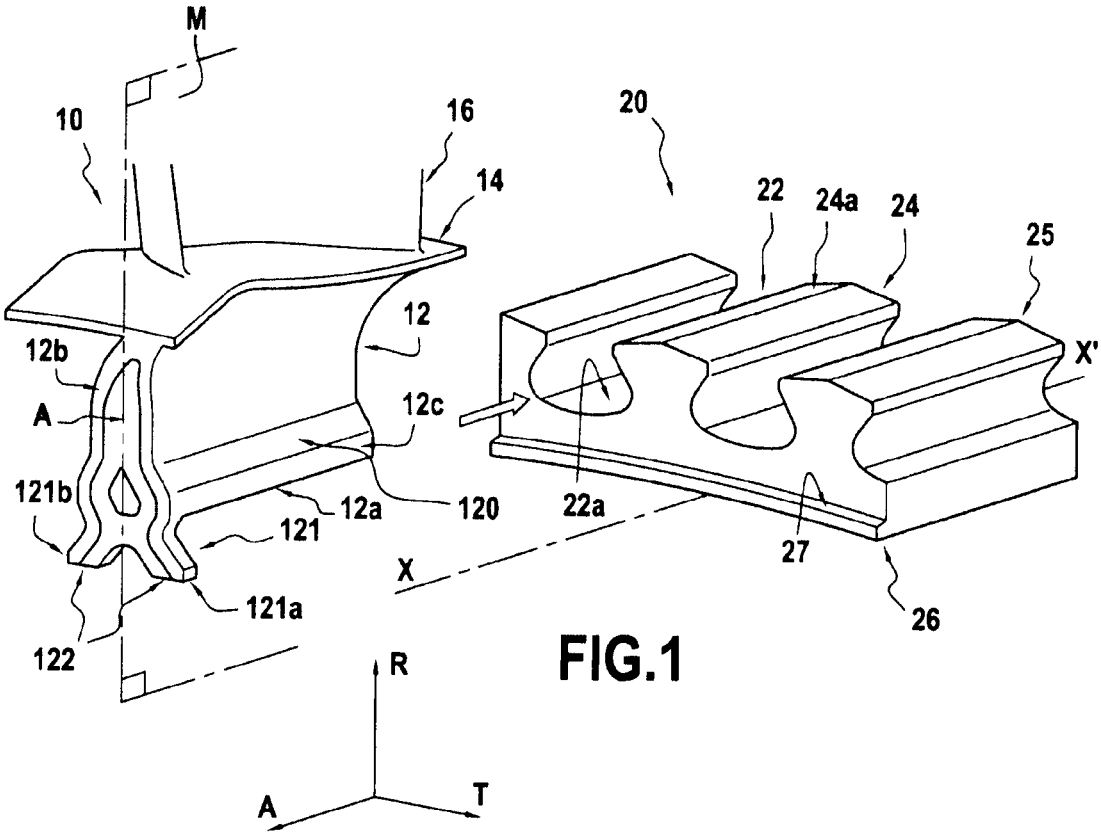
FIG. 1 is a perspective view showing part of the rotor of the invention while a blade is being mounted in a slot of the disk, in a first variant of a first embodiment.

FIG. 1 shows a blade 10 having a root 12 of the bulb type with its radial end including an enlarged portion 120 that extends axially between its upstream end 12*b* and its downstream end, each of which defines a respective front face (the front face on the upstream end 12*b* being referenced 12*b*'). The root 12 is surmounted by a platform 14 that extends axially (direction A) and transversely (direction T), and that is extended radially (direction R) by the airfoil 16. In order to mount the blade 10 on the disk 20, the root 12 is designed to be received in an axially-extending slot 22 of complementary shape.

Each slot 22 is defined between two solid disk portions 24 forming splines that extend, like the slot 22, in an axial direction, i.e. parallel to the axis X-X' of the turbomachine.

The openings and the bottoms 22*a* of the slots 22, and the tops 24*a* of the splines 24 face towards the periphery or the outer face 25 of the disk 20.

The front face or rim of the disk 20, constituting the upstream front face of the disk 20 in the embodiments described below with reference to FIGS. 1 to 8, is provided with a projecting annular shoulder 26 that is continuous and situated in the circular inner portion of the upstream front face of the disk 20 (in FIG. 1, this annular shoulder 26 extends along the inner edge of the upstream front face of the disk 20).

Figure 2:
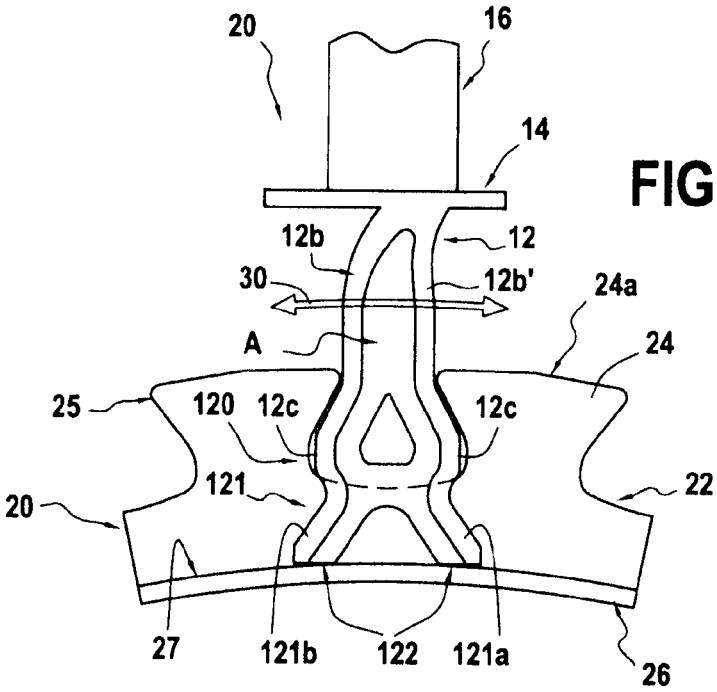
FIG. 2 is a fragmentary view in projection from the front face of the disk after the blade has been mounted in the slot.

In FIGS. 1 and 2, this annular shoulder 26 is continuous and defines an annular retaining face 27 facing towards the periphery or outer face 25 of the disk 20.

In order to co-operate with this retaining face 27, the root 12 of the blade 10 includes a projecting portion 121 that extends in the transverse direction T.

More precisely, in the first embodiment shown in FIGS. 1 to 4, the projecting portion 121 goes radially beyond the bottom face or base 12*a* of the enlarged portion 120 of the root 12 of the blade, extending it in the radial direction R beside the upstream end 12*b* of the root 12, which base 12*a* bears against the bottom 22*a* of the slot 22. This projecting portion 121 has two fins 121*a* and 121*b* that extend in the transverse direction T symmetrically on either side of the axial midplane M of the root 12, which plane is parallel to the axis of direction A of the root 12 and to the central axis X-X' of symmetry of the turbomachine. The two fins 121*a* and 121*b* are terminated by respective end faces forming bearing faces 122 that are substantially plane and suitable for coming into contact against the retaining face 27.

Furthermore, in the invention, the span or transverse (or circumferential) extent of the projecting portion 121, defined between the free ends of the two fins 121*a* and 121*b* is greater than the greatest distance between the two side faces 12*c* of the enlarged portion 120 of the root 12 of the blade 10. In other words, the enlarged portion goes transversely (i.e. laterally in direction T) in both directions beyond the axial projection of the two side faces 12 of the enlarged portion 120. This difference in width or span is not less than 5% and is preferably not less than 10%.

This serves to prevent, or to limit, any tilting about an axial direction parallel to the central axis X-X' of symmetry of the turbomachine (arrow 30 in FIG. 2). Furthermore, this arrangement has the advantage of limiting tilting by the effect of the ratio between the lever arms.

It can be understood that the bearing faces 122 may be machined so that their locations, shapes, and surface state are appropriate for bearing against the retaining face 27 of the shoulder 26.

The blade 10 is preferably made of composite material, and in an advantageous arrangement the root 12 of the blade 20 includes an insert A having a portion that constitutes the part of the projecting portion 121 or that constitutes the projecting portion 121.

The insert A thus forms an integral part of the root 12 of the blade 10 and it is preferably limited to a relatively short axial extent, beside the (upstream) end of the root 12.

Alternatively (configuration not shown), the insert extends inside the root 12 of the blade 10 over an axial extent that corresponds to more than one-third or even to more than half the axial extent of the root 12, or indeed over the entire axial extent of the root 12.

Furthermore, in the first embodiment shown in FIGS. 1 to 4, the insert A presents a (radial or transverse) section that constitutes an upside-down Y shape with the two top branches of the Y belonging to or constituting the two fins 121*a* and 121*b* of the projecting portion 121.

This upside-down Y shape for the projecting portion serves to increases the lever arms generated by contact between the bearing faces 122 and the retaining face 27 of the shoulder 26, thereby minimizing any residual tilting of the root 12 of the blade 10.

The root 12 of the blade generally forms an integral portion of the blade 10 throughout the process of fabricating the blade out of CMC material.

This insert A may also be made of CMC, using a preform or texture that is constituted by interleaved filaments, e.g. three-dimensional weaving, embedded in a ceramic matrix.

Thus, under such circumstances, the insert A comprises a fiber preform and a matrix of ceramic material. This is the configuration that it is advantageous to select for the solutions shown in FIGS. 4, 5, and 7.

Alternatively, the insert A may be made solely out of a ceramic matrix. This is the configuration that is advantageously selected for the solution shown in FIG. 3.

In either configuration, the matrix of the insert A is of the same chemical composition as the blade 10 and is in geometrical continuity with the matrix of the blade 10 (the ceramic matrix of the insert A and the matrix of the remainder of the blade 10, including the root 12 should be cast and baked simultaneously, so as to constitute a single matrix).

In the example shown in FIG. 1, the projecting portion 121, and in particular each fin 121*a* or 121*b*, includes a central portion facing towards the axial midplane M of the root 12 that is constituted by a portion of the insert A, and another portion (an outer portion that faces away from the axial midplane M of the root 12) that does not result from the insert A but from fabrication of the remainder of the blade 10, including the root 12, and that is formed by a preform or texture that is embedded in a matrix, and that is bonded by said matrix to the insert A.

In the other variants of the first embodiment (FIGS. 3 and 4), and in the second embodiment (FIGS. 5 to 8), the projecting portion 121, and in particular each fin 121*a* or 121*b* is constituted solely by a portion of the insert A.

With reference to FIG. 3, showing the second variant of the first embodiment, apart from the fact that the projecting portion 121 results solely from the insert A (preferably being constituted by a ceramic binder/matrix and by a preform), it can be seen that the projecting portion 121 is of a shape such that the two fins 121*a* and 121*b* of the upside-down Y shape are flatter than in the first variant shown in FIGS. 1 and 2, the insert A almost forming an upside-down T-shape.

With reference to FIG. 4 showing the third variant of the first embodiment, in addition to the projecting portion 121 resulting solely from the insert A (preferably being constituted solely by a ceramic binder/matrix), it can be seen that the projecting portion 121 presents a shape that bears over the entire width of the bottom surface or base 12*a* of the root 12 and in which the two fins 121*a* and 121*b* are flatter than in the first variant of the first embodiment (FIGS. 1 and 2), extending sideways over a span that is greater than in the second variant of FIG. 3.

Figure 7:
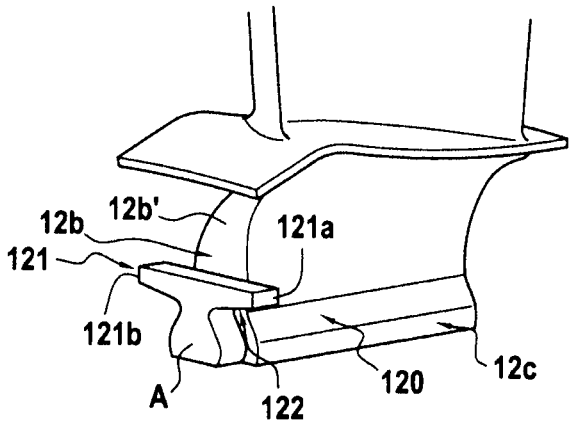
FIGS. 7, 8A, and 8B are similar respectively to FIGS. 5, 6A, and 6B for a second variant of the second embodiment of the rotor of the invention.
Figure 8A:
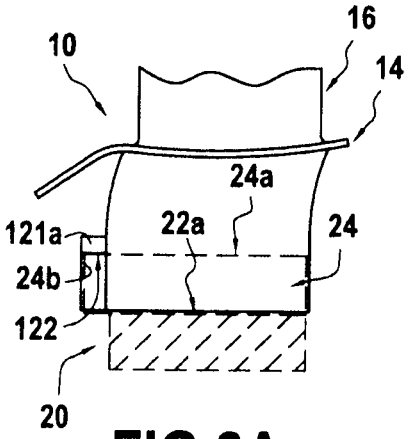
Figure 8B:
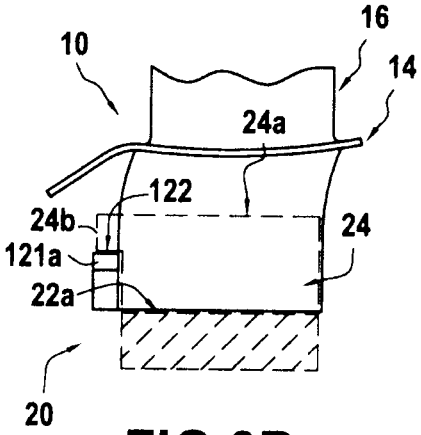

Reference is now made to the second embodiment shown in FIGS. 5, 6A, and 6B (first variant) and in FIGS. 7, 8A, and 8B (second variant). In this embodiment, the insert A presents a (radial or transverse) section that is T-shaped with the horizontal top bar of the T-shape including the two fins 121*a* and 121*b* of the projecting portion 121. More precisely, this horizontal top branch of the T-shape constitutes the two fins 121*a* and 121*b* of the projecting portion 121.

In the first embodiment (FIGS. 1 to 4), and in the second embodiment (FIGS. 5 to 8), said projecting portion 121 extends in the transverse direction T beyond the two side faces 12*c* of the enlarged portion 120 of the root 12 of the blade 10. In other words, the span or the transverse (or circumferential) extent of the projecting portion 121, between the free ends of the two fins 121*a* and 121*b*, is greater than the greatest distance between the two side faces 12*c* of the enlarged portion 120 of the root 12.

It should be observed that in the second embodiment (FIGS. 5 to 8), the projecting portion 121 does not extend radially (direction R) beyond the bottom face or base 12*a* of the enlarged portion 120 of the root 12.

As can be seen in FIG. 5, the T-shaped insert A is housed inside the root 12 of the blade 10, at the location of the upstream end 12*b* of the enlarged portion 120 of the root 12, with the exception of the two fins 121*a* and 121*b* that project beyond the side faces 12*c* of the root 12, above the enlarged portion 120 or bulb. In this embodiment, the presence of the insert A does not cause the root 12 of the blade to be any longer (axial direction).

For assembly, in a first solution that can be seen in FIG. 6A, an unmodified prior art disk 20 is used with the two fins 121*a* and 121*b* bearing against the tops 24*a* of the two splines 24 that are adjacent to the slot 22 receiving the root 12 of the blade 10 in question.

In a second assembly configuration, as shown in FIG. 6B, a modified disk 20 is used that presents a set-back annular shoulder 26 that is situated in the circular outer portion of the upstream front face of the disk 20 (in FIG. 6B, this annular shoulder 26 is situated along the outer edge of the upstream front face of the disk 20). As a result, this annular shoulder 26 bears against the front faces of the splines 24 so that it is discontinuous (it is made up of identical angular sectors that are regularly spaced apart, corresponding to the splines 24 that are separated from one another by the slots 22) and it opens out to the outer or peripheral face 25 of the disk 20. Under such circumstances, the two fins 121*a* and 121*b* come to bear radially against the discontinuous annular retaining face 27 facing towards the periphery or outer face 25 of the disk 20.

In the second variant of the second embodiment, as shown in FIGS. 7, 8A, and 8B, the T-shaped insert A is housed in the root 12 of the blade 10 at the location of the upstream end 12*b* of the root 12. More precisely, this insert A is situated completely axially in line with the front face 12*b*' of the root, the root of the T shape formed by the insert substantially extending the outline of the enlarged portion 120 or bulb of the root 12 in an axial direction (direction A). Thus, in this variant, the projecting portion 121 projects axially from a front face 12*b*' of the enlarged portion 120 of the root 12 of the blade.

Furthermore, the span or transverse (or circumferential) extent of the projecting portion 121 between the free ends of the two fins 121*a* and 121*b* is greater than the greatest distance between the two side faces 12*c* of the enlarged portion 120 of the root 12 of the blade 10. Furthermore, in this variant, the two fins 121*a* and 121*b* are situated radially at a location above the enlarged portion 120 or bulb, between the bulb and the platform 14. Under such circumstances, the presence of the insert A causes the root 12 of the blade to be longer (axial dimension) than in the configuration where there is no projecting portion 121 but only the enlarged portion 120 or bulb.

In the second variant of the second embodiment, as can be seen in FIGS. 8A and 8B, the blade 10 is mounted by means of the splines 24. More precisely, in this variant, the two splines 24 defining the slot in which the blade 10 is received presents respective projecting upstream ends 24*b* constituting axial projections for bearing against the bearing face 122 of respective ones of the two fins 121*a* and 121*b* of the projecting portion 121.

In FIG. 8A, it is the top face (the top 24*a*) of the upstream end 24*b* that bears radially against the bearing face 122 of a respective one of the two fins 121*a* and 121*b* of the projecting portion 121 (the bearing face 122 is then formed by the bottom or inner face of each of the fins 121*a* and 121*b*).

In FIG. 8B, the upstream end 24*b* has a reentrant shoulder in its radially inner portion, against which the bearing face 122 of each of the two fins 121*a* and 121*b* of the projecting portion 121 comes to bear radially (the bearing face 122 is then formed on the top or outer face of each fin 121*a* and 121*b*).

In all configurations, the blade 10 is mounted on the disk 20 by inserting its root 12 in the axial direction A into a slot 22, with the front face or upstream face of the disk 20 having the root 12 inserted therein and with the root 12 being caused to slide axially, thereby bringing the enlarged portion into the inside of the slot 22.

It can be understood from the above explanations that the existence of the projecting portion 121 on the blade root 12 and of the annular shoulder 26 and/or the upstream end 24*b* projecting from the disk 20 does not impede such assembly by axial engagement.

Similarly, in another preferred arrangement, the radial position of the two fins 121*a* and 121*b* is offset relative to the radial position of the enlarged portion 120. Thus, in FIGS. 1 to 4, the two fins 121*a* and 121*b* are placed at a radial height or position that is lower than that of the enlarged portion 120, which enlarged portion is above and overlies the two fins 121*a* and 121*b*, and in FIGS. 5 to 7, the two fins 121*a* and 121*b* are positioned at a radial height or position that is higher than the radial height or position of the enlarged portion 120 which then underlies the two fins 121*a* and 121*b*.

In other words, the projection of the outline of the enlarged portion 120 in an axial direction (direction A) preferably does not intersect the two fins 121*a* and 121*b*.

What is claimed is:

1. A turbomachine blade made of composite material, in which a long dimension defines a radial direction, the blade including a root extending in an axial direction, with a bulb-shaped end suitable for engaging in a slot of a rotor disk and radially locking the root in the slot, wherein the bulb-shaped end of the root of the blade includes a first enlarged portion and a second projecting portion, wherein the second projecting portion is beside a front face of the first enlarged portion, and extends in a transverse direction, wherein the second projecting portion includes two fins that are symmetrical relative to an axial midplane of the root and each fin has a bearing face suitable for limiting tilting of the blade relative to the rotor disk about the axial direction, wherein a transverse extent of the projecting portion between free ends of the two fins is greater than a greatest distance between two side faces of the enlarged portion of the root of the blade, and wherein the root of the blade includes an insert having a portion that forms at least a part of the second projecting portion or that constitutes the second projecting portion.

2. A turbomachine blade according to claim 1, wherein the second projecting portion extends axially beyond a front face of the first enlarged portion of the root of the blade.

3. A turbomachine blade according to claim 1 or 2, wherein the second projecting portion extends in a transverse direction beyond the two side faces of the first enlarged portion of the root of the blade.

4. A turbomachine blade according to claim 1, wherein the second projecting portion extends in a radial direction beyond the bottom face of the first enlarged portion of the root of the blade.

5. A turbomachine blade according to claim 1, wherein the insert comprises a fiber preform with a matrix of ceramic material.

6. A turbomachine blade according to claim 1, wherein the insert presents a section having an upside-down Y-shape with the two top branches of the Y-shape forming parts of or constituting the two fins of the second projecting portion.

7. A turbomachine blade according to claim 1, wherein the insert presents a section that is T-shaped with the horizontal top branch of the T shape including or constituting the two fins of the second projecting portion.

8. A turbomachine blade according to claim 1, wherein the radial position of the two fins is offset relative to the radial position of the first enlarged portion.

9. A turbomachine rotor comprising blades according to claim 1 and a metal disk that is provided at its periphery with slots extending in an axial direction for receiving the roots of the blades, wherein the disk is provided with a retaining face facing towards the periphery of the disk and against which the bearing faces of the fins of the second projecting portion of each blade comes to bear.

10. A rotor according to claim 9, wherein the retaining face is formed by an annular shoulder facing towards the periphery of the disk and placed on one of the front faces of the disk.

11. A low pressure turbine, including at least one blade according to claim 1.

12. A turbomachine, including at least one blade according to claim 1.

* * * * *

UNITED STATES PATENT AND TRADEMARK OFFICE

CERTIFICATE OF CORRECTION

PATENT NO. : 8,951,017 B2
APPLICATION NO. : 13/190809
DATED : February 10, 2015
INVENTOR(S) : Damien Cordier et al.

It is certified that error appears in the above-identified patent and that said Letters Patent is hereby corrected as shown below:

On the title page, Item (75), the 3rd Inventor's city of residence information is incorrect. Item (75) should read:

--(75) Inventors: Damien Cordier, Les Ecrennes (FR);
Jean-Luc Soupizon, Vaux Le Penil (FR);
Julien Mateo, Carignan De Bordeaux (FR);
Georges Habarou, Le Bouscat (FR)--

Signed and Sealed this
Nineteenth Day of May, 2015

Michelle K. Lee

Michelle K. Lee
*Director of the United States Patent and Trademark Office*